United States Patent [19]

Scott

[11] 4,374,598

[45] Feb. 22, 1983

[54] SECURITY BARS

[76] Inventor: Edwin C. Scott, 96 Capella St., Coorparoo Heights, Queensland 4151, Australia

[21] Appl. No.: 150,947

[22] Filed: May 19, 1980

[51] Int. Cl.[3] ..... E05C 17/02

[52] U.S. Cl. ..... 292/259 R

[58] Field of Search ..... 292/259, 262, 305, 339, 292/DIG. 46; 211/105.1, 123; 339/252 P, 256

[56] References Cited

U.S. PATENT DOCUMENTS

| | | | |
|---|---|---|---|
| 1,581,185 | 4/1926 | Ellis | 292/262 |
| 1,800,254 | 4/1931 | Holmes | 339/256 S |
| 2,156,748 | 5/1939 | Wolker | 211/123 |
| 2,196,571 | 4/1940 | Van Gorden | 211/123 X |
| 2,314,751 | 3/1943 | Woodward | 339/256 S |
| 2,488,702 | 11/1949 | Brochstein | 211/123 |
| 3,251,619 | 5/1966 | Schlage | 292/341.18 |
| 3,382,479 | 5/1968 | Cooney | 339/256 S |
| 3,512,821 | 5/1970 | Sovio et al. | 292/262 X |

FOREIGN PATENT DOCUMENTS

| | | | |
|---|---|---|---|
| 1429768 | 11/1968 | Fed. Rep. of Germany | 211/105.1 |
| 741771 | 4/1933 | France | 211/105.1 |

*Primary Examiner*—Richard E. Moore

*Attorney, Agent, or Firm*—Fleit & Jacobson

[57] ABSTRACT

A security bar assembly for an opening includes an elongate bar extending across the opening, and a socket connector assembly at each end of the bar to be secured to the respective side of the opening by means of a fastening accessible only from within the socket. At least one of the latter sockets is provided with an abutment adjacent its outer end extending inwards from the socket into abutting relationship with the bar when the bar is supported in the socket and one end of the bar is provided with retractable pins extending beyond the bar upon insertion into the socket beyond the abutment.

13 Claims, 1 Drawing Figure

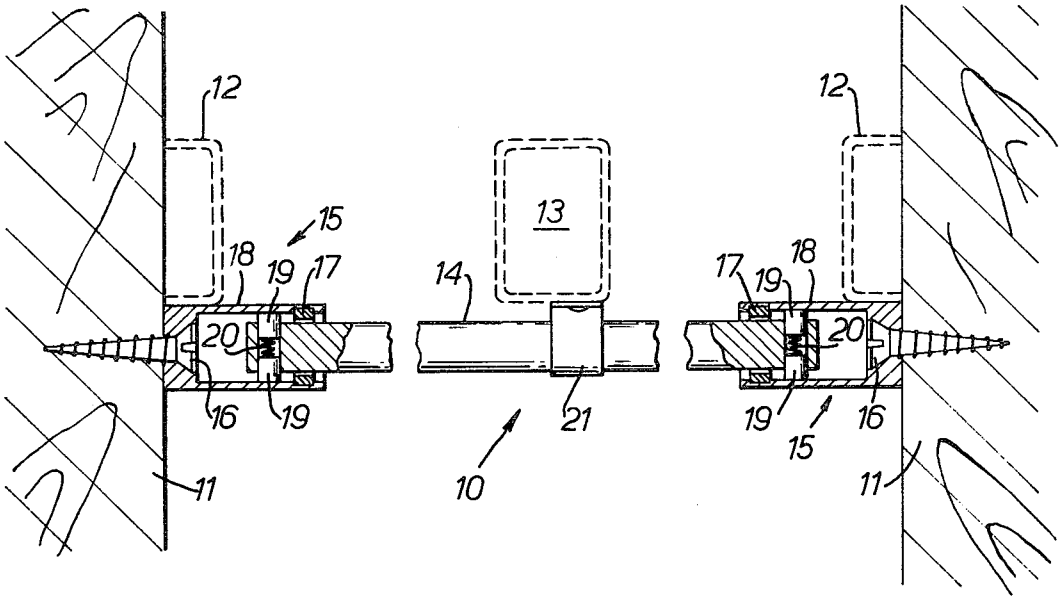
12
11
16
20
18
15
19
17
19
13
21
10
14
15
17
19
19
18
20
16
12
11

SECURITY BARS

BACKGROUND OF THE INVENTION

This invention relates to improvements to security bars.

Many types of security bars are presently available but the present invention has been devised to overcome the disadvantage of the type having readily accessible connecting means such as visible screws and rivets and the like, and to provide an assembly which may be assembled across an existing window and in which all fastenings will be concealed whereby entry through the window can only be gained by forcing the security bars.

SUMMARY OF THE INVENTION

With the foregoing and other objects in view, this invention resides broadly in a security bar assembly for an opening, including an elongate bar adapted to extend across an opening, a socket connector assembly at each end thereof adapted to be secured to the respective side of said opening by means of a fastening accessible only from within said socket assembly, at least one of the latter being provided with abutment means adjacent its outer end adapted to extend inwards from the socket into substantially abutting relationship with the bar when the latter is supported in said socket and one end of said bar being provided with retractable pins adapted to extend beyond the bar upon insertion into said socket beyond said abutment means. A spring loaded connection means is provided between at least one bar end and its corresponding socket assembly, said connection means being adapted to lock said bar end to said socket assembly.

BRIEF DESCRIPTION OF THE DRAWING

In order that the invention may be more readily understood and put into practical effect, reference will now be made to the accompanying drawing which illustrates a preferred embodiment of the invention, partially in cross section.

DESCRIPTION OF THE PREFERRED EMBODIMENTS

As shown in the drawing, the window opening 10 is defined by jambs 11 and is enclosed by a window such as louvres having outer peripheral frames 12 and which may have an intermediate frame 13. A security bar 14 is adapted to extend between opposite jambs 11 and for this purpose is supported at opposite ends within socket assemblies 15 screwed to the respective jambs 11 by screws 16 accessible only from the interior of the socket assemblies 15. As shown, each socket assembly provides an elongate substantially cylindrical socket portion 18 of slightly larger internal diameter than the external diameter of the bar 14 and is terminated at its outer end by an abutment member or flange 17 in the form of a conventional circlip or a fitted circlip located in a groove at the outer end of the socket portion 18 and which extends inwards to closely surround the bar 14.

Of course, the abutment member 17 may be also constituted by a flange extending peripherally around the open mouth of the cylindrical socket portion 18 and extending inwards to the bar 14.

Each end of the bar 14 is provided with a transverse aperture within which there are slidably disposed a pair of pins 19 which are spring-urged away from one another by an internal spring 20 supported in the aperture to maintain the pins in their expanded position in which they extend outwardly from the bar to prevent the latter being retracted past the abutment member or flange 17. Additionally, it will be seen that the socket assemblies 15 are made of such length as to provide end play between the ends of the bar 14 and the base of the socket assemblies 15. This is to enable the security bar 14 to be operatively secured in the socket assemblies 15 after the latter have been secured to the respective jambs 11.

To install the bar, the socket assemblies 15 are attached to opposite jambs 11 and a temporary sleeve which may be a cardboard spiral or a sleeve made of other suitable material, is placed about the bar 14 at each end thereof to hold the pins 19 in their retracted position within respective aperture. One end of the bar is inserted into a socket assembly 15 with the temporary sleeve being used to maintain the pins in their retracted position until they pass the abutment flange 17, whereafter the sleeve is removed so that the pins move outwardly to prevent that end of the bar being retracted from the socket without forcibly removing the socket assembly from the jamb.

The engaged end of the bar is then slid along within the socket assembly 15 so that the opposite end of the bar is inserted in a similar manner into the opposite socket assembly 15 with pins in the retracted position. Once the bar is moved to place the pins 19 beyond the abutment member or flange 17 and the sleeve removed, the bar is securely supported in the opening and, as mentioned previously, the bar cannot be removed without forcing the bar or forcibly removing the socket assemblies from the jambs. Of course, this arrangement enables the bars to be placed at the desired spacing across the window, such as at a regular spacing across a louvre window to enable the blades to open clear of the bars, and furthermore, the bars can be installed at any stage either prior to or subsequent to the window being installed.

In the embodiment illustrated, the circlip 17 is utilised to provide the abutment flange and to prevent retraction of the bar from the socket assembly. The circlips may be engaged in their supporting slots subsequent to the bars being positioned but preferably, the circlips are inserted prior to the bar being engaged within the socket to enable a close tolerance to be maintained between the bar and the inner edge of the circlip. As shown, a clip 21 may be provided to connect the bar 14 to the frame 13 to support the bar at a position intermediate its end. Furthermore, if desired, the bar may be provided with retracting pins at one end only, and the socket assembly for this end would have an inner circumferential groove to receive said pins so as—to prevent the pin and thus the bar moving in either direction along the axis of the socket.

In a further modification, one or both bar ends may have a circumferential groove in which is situated a circlip having an outer peripheral surface which tapers outwardly and away from the bar end and the socket assembly may have an inner circumferential groove to mate with the circlip. When the bar end is inserted into the socket assembly, the circlip on reaching the socket groove will spring outwardly into the groove to engage therewith so that the bar end is locked to the socket assembly with the circlip extending between respective aligned grooves. In the above modifications, of course, an abutment member 17 is not required.

When only one end of the bar has connection means in the form of retractable pins or a circlip and it is desired to place the bar between the socket assemblies, the plain end of the bar is first inserted into one socket assembly until the connection end of the bar is inwards of the other socket assembly. The bar is then slid longitudinally of its length so that the connection end of the bar is inserted into the corresponding socket assembly so as to lock therewith and retain the bar between respective socket assemblies.

Of course, the cross-sectional configuration of the bar and pins and socket may be of any shape as desired and it is to be understood that all such modifications and variations as would be apparent to persons skilled in the art are deemed to fall within the broad scope and ambit of the invention as is defined in the appended claims.

What is claimed is:

1. A security bar assembly for an opening including an elongate bar adapted to extend across an opening defined between a pair of members; a pair of socket connector assemblies each adapted to be secured to a respective one of said members defining said opening, each said socket assembly including a socket opening for receiving respective opposite ends of said bar; means for fastening said socket assemblies to the respective said members, said means being accessible only through the socket openings; and spring loaded connection means provided between at least one bar end and its corresponding socket assembly, said connection means being adapted to lock said bar end to said socket assembly.

2. A security bar assembly according to claim 1, wherein said socket assemblies allow longitudinal sliding of the ends of said bar in said socket assemblies for assembly purposes.

3. A security bar assembly according to claim 1 or claim 2, wherein spring loaded connection means are arranged between both ends of said bar and its corresponding socket assemblies.

4. A security bar assembly according to claim 3, wherein said connection means includes opposed spring loaded pins mounted for reciprocation in transverse apertures in at least one bar end, at least one of said socket assemblies including abutment means for cooperating with said pins.

5. A security bar assembly according to claim 1 or claim 2, wherein said connection means includes opposed spring loaded pins mounted for reciprocation in transverse apertures in at least one bar end, at least one of said socket assemblies including abutment means for cooperating with said pins.

6. A security bar assembly according to claim 4, wherein said abutment means are defined by a circlip mounted in an internal circumferentially extending groove adjacent the outer end of said socket assembly.

7. A security bar assembly according to claim 5, wherein said abutment means are defined by a circlip mounted in an internal circumferentially extending groove adjacent the outer end of said socket assembly.

8. A security bar assembly according to claim 4, wherein said abutment means are defined by a peripheral flange adjacent the outer end of said socket assembly.

9. A security bar assembly according to claim 5, wherein said abutment means are defined by a peripheral flange adjacent the outer end of said socket assembly.

10. A security bar assembly according to claim 5, wherein said abutment means are defined by a circumferentially extending pin-receiving groove within said socket assembly.

11. A security bar assembly according to claim 1, mounted in a window opening including a frame supporting louvres, said bar assembly being arranged adjacent to said frame.

12. A method of connecting a security bar across an opening provided with oppositely disposed socket assemblies comprising the steps of:

(1) inserting one end of said bar into the said socket assembly until the other end thereof is disposed inwardly of the other said socket assembly and free from insertion therein, (2) sliding said bar longitudinally of its length so that said other end thereof enters said other socket assembly to a limited extent whereby said one end remains in said one socket assembly; at least said other end of said bar having spring loaded retaining means adapted to cooperate with corresponding means on said other socket assembly whereby said bar is locked to said socket assemblies, wherein a sleeve is fitted about said bar other end to maintain said spring loaded retaining means in an unexpanded position prior to cooperation of said retaining means with said corresponding means on said other socket assembly, and (3) removing said sleeve from said bar other end to enable said retaining means to cooperate with the corresponding means on said other socket assembly.

13. A method of connecting a security bar as in claim 12 wherein a bracket is mounted intermediate the ends of said bar for attachment to a frame member spanning said opening.

* * * * *